United States Patent [19]

Heep et al.

[11] Patent Number: 4,461,451

[45] Date of Patent: Jul. 24, 1984

[54] SLIDE VALVE FOR CONTAINER OF BULK MATERIAL

[75] Inventors: Dieter Heep, Bergatreute; Norbert Eberhard, Ertingen, both of Fed. Rep. of Germany

[73] Assignee: Waeschle Maschinenfabrik GmbH, Ravensburg, Fed. Rep. of Germany

[21] Appl. No.: 333,393

[22] Filed: Dec. 22, 1981

[30] Foreign Application Priority Data

Dec. 30, 1980 [DE] Fed. Rep. of Germany ..... 3049473

[51] Int. Cl.[3] ..... F16K 31/122; F16K 1/12

[52] U.S. Cl. ..... 251/63.5; 251/118; 251/144

[58] Field of Search ..... 251/144, 118, 63.5

[56] References Cited

U.S. PATENT DOCUMENTS 2,549,689 4/1951 Jurs, Jr. ..... 251/144 X

FOREIGN PATENT DOCUMENTS 561331 4/1957 Italy ..... 251/282

*Primary Examiner*—Arnold Rosenthal

*Attorney, Agent, or Firm*—Michael J. Striker

[57] ABSTRACT

A slide valve for a container with an upright supply of bulk material has a sealing element with a sealing face, a tubular slider movable relative to an inlet opening between an open position in which it releases an annular gap for passing the bulk material and a closed position in which it closes the annular gap, and a deflecting cone located under the inlet opening, having a base of a diameter exceeding the diameter of the inlet opening, and serving as a guide for the tubular slider, wherein the tubular slider has a lower end face which is closed and an upper edge which abuts against the sealing face in the closed position and is substantially flush with the conical face of the deflecting cone in the open position, and the sealing face is located above the inlet opening.

14 Claims, 2 Drawing Figures

SLIDE VALVE FOR CONTAINER OF BULK MATERIAL

BACKGROUND OF THE INVENTION

The present invention relates to a slide valve for containers with upright supply of bulk materials.

Slide valves of the above mentioned general type are known in the art. A known slide valve has a deflecting cone arranged coaxially to an inlet opening of a container, and a pneumatically displaceable tubular slider which in open position releases an annular inlet gap and in closed position abuts with its upper edge against a sealing face which is protected from flow of the bulk material. A tubular valve which uses this principle is known from the German Pat. No. 1,675,371. In the first mentioned construction, the deflecting cone is arranged on supporting members in standing position on the upper connecting flange of a tube which opens into a container with bulk material and serves as shield guide for the tubular slider connected with the piston rod of a cylinder-and-piston unit which is arranged in a tubular extension of the deflecting cone. The upper edge of the tubular slider in its open position is substantially flush with the connecting flange, which can be connected, for example, with an outlet flange of a feeding funnel. For closing, the tubular slider is displaced upwardly until its upper edge abuts against a sealing face provided above the lower edge of the tubular extension of the deflecting cone and protected from the bulk material. This construction has the advantage that the flow of bulk material is reliably closed. The disadvantage of this construction, however, is that the sliding valve is arranged completely outside of the container for which it is provided and a simple connection of an incoming supply conduit is not possible. Instead, a special feeding funnel or an intermediate container with funnel-shaped outlet must be utilized. Since the subsequently arranged container with closed sliding valve is often under pressure, there is another disadvantage of the known construction in the fact that at least two pressure-tight seals are required, namely the seal for the upper edge of the tubular slider and the seal or seals between the outer surface of the tubular slider and a tube serving to guide the latter. It is further unsatisfactory that the tubular slider in the container under pressure opens unintentionally, namely when the cylinder-and-piston unit is untight or its control medium, generally pressure air, drops.

SUMMARY OF THE INVENTION

Accordingly, it is an object of the present invention to provide a slide valve for a container with an upright supply of bulk material which avoids the disadvantages of the prior art.

More particularly, it is an object of the present invention to provide a slide valve for a container with an upright supply for bulk material, which can be brought inside the container, has only one pressure-responsive seal, and is secured against unintentional opening in the event of failures in a drive for a tubular slider.

In keeping with these objects, and with others which will become apparent hereinafter, one feature of the present invention resides, briefly stated, in a slide valve in which a deflecting cone is located under an inlet opening, has a base portion of a greater diameter than the inlet opening, and serves as a guide for a surrounding tubular slider, a lower end face of the tubular slider is closed, and an upper edge of the tubular slider in open position is substantially flush with the conical face of the deflecting cone, wherein a sealing face is located above the inlet opening.

In addition to the fact that the slider valve designed in accordance with the present invention is arranged inside the container for bulk material and attains the advantages of reliable closing in a flow of bulk material, the inventive slide valve also possesses the advantage that with the tubular slider closed its inner space remains pressureless, so that the seal arranged in the guiding face for the tubular slider is not subjected to pressure loading. Simultaneously, the differential pressure acting upon the closed bottom part of the tubular slider has a tendency to hold the tubular slider in closed position, so that in the event of failure of its drive it is secured against unintentional or premature opening, as long as the container is under pressure.

In accordance with another feature of the present invention, the deflecting cone is suspended on tubular supporting members which are arranged inside a space between an inlet tube and the tubular slider.

Still another feature of the present invention is that a cylinder-and-piston unit is carried on the deflecting cone below the same and has a piston rod connected with a bottom plate which closes the tubular slider from below.

A further feature of the present invention is that a helical pressure spring abuts against a piston of the cylinder-and-piston unit so as to compensate for the weight of the tubular slider.

Still a further feature of the present invention resides in the fact that a working medium for the cylinder-and-piston unit is supplied through the interior of at least one of the tubular supporting members of the deflecting cone.

Yet another feature of the present invention is that an electrical contact for an electrically operated end switch for the tubular slider extends through one of the tubular supporting members of the deflecting cone.

In accordance with an additional feature of the present invention, the deflecting cone has a region of maximum diameter and transits in this region into a cylindrical face which forms a guide for the tubular slider.

Finally, the inlet tube has a portion which is located between a plane containing the sealing face and the inlet opening and serves for protecting the sealing face from the flow of bulk material.

The novel features which are considered characteristic of the present invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
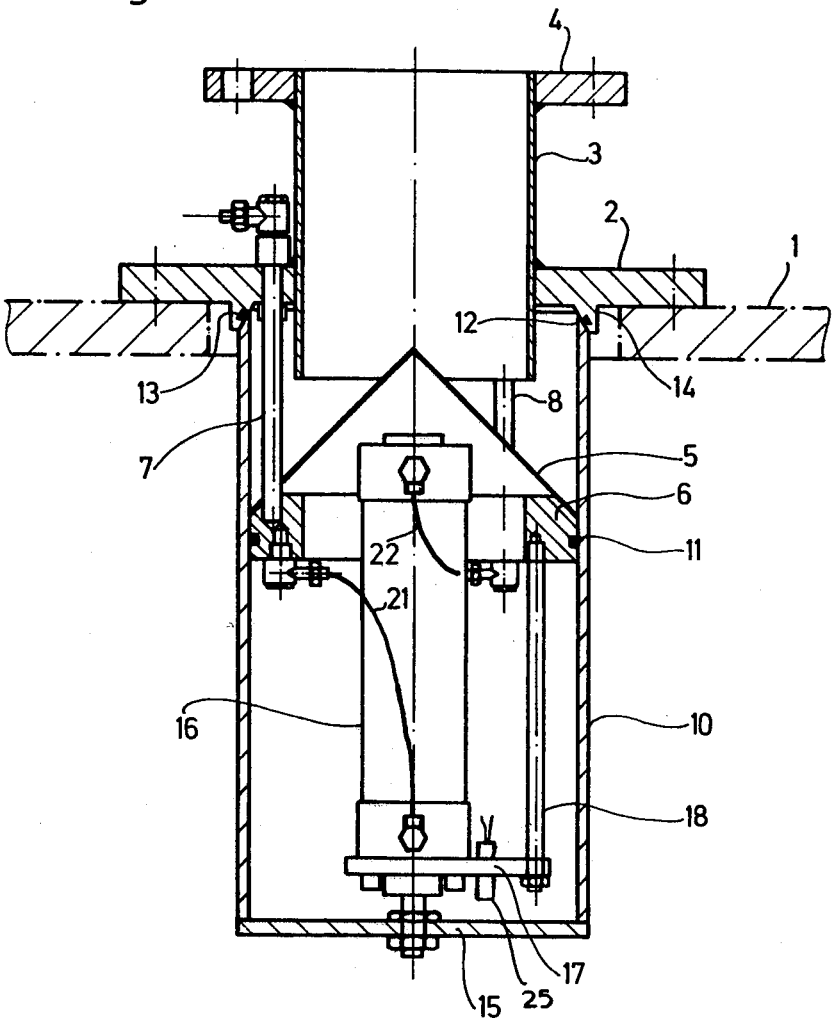
FIG. 1 is a view showing a longitudinal section of a slide valve in accordance with the present invention.

A slide valve in accordance with the invention is shown in FIG. 1 and has a flange 2 which is connected by screws with a schematically shown flange cover 1 of a container of bulk material. The flange 2 surrounds an inlet tube 3 having a connecting flange 4 which is connected with an outlet of a silo for bulk material or another suitable supply element. The inlet tube 3 passes through the flange 2 and extends at a certain distance downwardly beyond the latter. The inlet tube 3 has a lower mouth which forms an inlet opening.

The slide valve further has a deflecting cone 5 which is located opposite to the inlet opening with formation of a wide annular inlet gap. The deflecting cone 5 rests on a ring 6 which, in turn, is suspended on three hollow supporting members 7, 8, 9, as can be more clearly seen from FIG. 2. The supporting members 7–9 extend through the flange 2 and are fixedly connected therewith. The ring 6 has a cylindrical outer surface which serves as a guide for a tubular slider 10. A seal formed, for example, as an O-ring 11 is arranged in a groove of the cylindrical outer surface of the ring 6. An upper edge 12 of the tubular slider 10 abuts, in the shown closed position, against an annular seal 13. As can be seen from FIG. 1, the upper edge 12 of the tubular slider 10 is inclined, and an annular shoulder 14 provided at the lower side of the flange 2 is also inclined in correspondence with the inclination of the upper edge 12. The above mentioned annular seal 13 is inserted in the inclined annular shoulder 14 of the flange 2.

The lower end of the tubular slider 10 is closed by a bottom plate 15. A piston rod of a cylinder-and-piston unit 16 engages with the bottom plate and the unit rests on a supporting plate 17. The supporting plate 17 is connected, in turn, by three bars 18, 19, 20 with the ring 6. The cylinder-and-piston unit 16 is advantageously double-acting. It is supplied with a working medium, generally pressurized air, via the hollow supporting members 7 and 8. The supply system includes schematically shown conduits 21 and 22 which communicate via connecting fittings and respective openings in the ring 6 with the tubular supporting members 7 and 8.

The piston stroke of the cylinder-and-piston unit 16 is so selected that the upper edge 12 of the tubular slider 10 is flush, in the not shown open position, with the outer face of the deflecting cone 5. For signalling the control position and the open position, an end switch 25 can be arranged in the space between the deflecting cone 5 and the bottom plate 15. An electric conductor for the end switch can extend through the supporting member 9 outwardly.

In the open position of the tubular slider 10, the bulk material flows out of the inlet tube 3 via the ring-shaped gap delimited by the inlet opening of the inlet tube 3 and the deflecting cone 5 and then flows around the tubular slider 10 into the container. The extension of the inlet tube 3 downwardly over the flange 2 provides that in the region of the annular shoulder 14 which receives the seal 13 no bulk material is supplied in the event that the supply of bulk material is interrupted, not only because of premature lifting of the tubular slider 10, but also because of the continuing filling of the container until the bulk material comes to rest in correspondence with its natural angle of incline.

After lifting the tubular slider 10, its upper edge is sealed because of the abutment against the seal 13. When the container is brought under pressure, the entire space closed by the tubular slider 10 remains without pressure. As a result of this, it is provided that the seal 11, which is mechanically loaded by lifting and lowering of the tubular slider 10, is not subjected to an additional loading by different pressure at its two sides. It is also provided that the bottom plate 15 of the tubular slider 10 acts as a piston bottom with which the tubular slider 10 is pressed more strongly against the seal 13 with increase of the pressure in the container. In the event of defects in the cylinder-and-piston unit 16, the tubular slider 10 is nevertheless reliably held in its closed position until the pressure in the container continues to increase.

Figure 2:
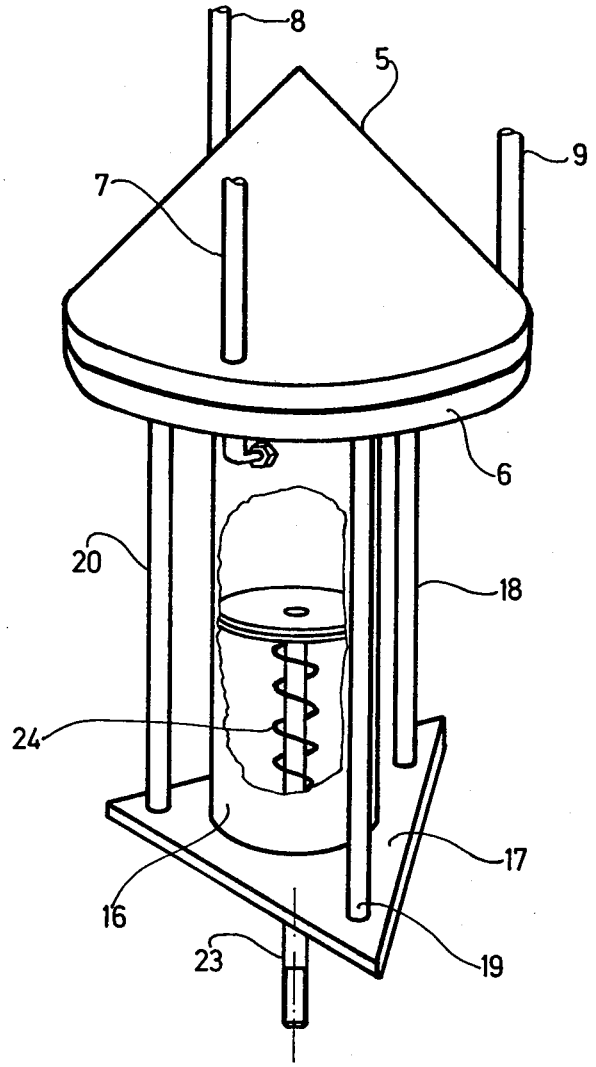
FIG. 2 is a perspective view of some parts of the inventive slide valve of FIG. 1.

FIG. 2 shows the deflecting cone 5 suspended on the supporting members 7–9 and resting on the ring 6, with the seal 11, as well as the partially sectioned cylinder-and-piston unit 16 resting on the supporting plate 7 which, in turn, is connected by the bars 18–20 with the ring 6. This Figure also shows that, for increasing the safety against premature opening of the slide valve, a helical pressure spring 24 is arranged on the piston rod 23 of the cylinder-and-piston unit 16. The helical pressure spring 24 is so selected that in loaded condition, that is in the closed position of the tubular slider 10, its own weight is approximately compensated.

It will be understood that each of the elements described above, or two or more together, may also find a useful application in other types of constructions differing from the types described above.

While the invention has been illustrated and described as embodied in a slide valve for container with an upright supply of bulk material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A slide valve for a container with an upright supply of a bulk material, comprising means forming an inlet opening of a predetermined diameter and including an inlet tube; sealing means including a sealing face; a tubular slider movable relative to said inlet opening between an open position in which it releases an annular gap for passing the bulk material and a closed position in which it closes said annular gap, said inlet tube forming together with said tubular slide an annular space; a deflecting cone with a conical face, said deflecting cone being located under said inlet opening, having a base of a diameter exceeding the diameter of said inlet opening, and serving as a guide for said tubular slider which surrounds said deflecting cone, said tubular slider having a lower end face which is closed and an upper edge which abuts against said sealing face in said closed position and is substantially flush with said conical face of said deflecting cone in said open position, and said sealing face being located above said inlet opening; means for supporting said deflecting cone and located in said annular space, said means for supporting said deflecting cone including a plurality of tubular supporting members arranged so that a working medium is supplied through the interior of at least one of said tubular supporting members to said pneumatic means.

2. A slide valve for a container with an upright supply of a bulk material, comprising means forming an inlet opening of a predetermined diameter; sealing means including a sealing face; a tubular slider movable relative to said inlet opening between an open position in which it releases an annular gap for passing the bulk material and a closed position in which it closes said annular gap; a deflecting cone with a conical face, said deflecting cone being located under said inlet opening, having a base of a diameter exceeding the diameter of said inlet opening, and serving as a guide for said tubular slider which surrounds said deflecting cone, said tubular slider having a lower end face which is closed and an upper edge which abuts against said sealing face in said closed position and is substantially flush with said conical face of said deflecting cone in said open position, and said sealing face being located above said inlet opening; an electrically operated end switch provided for said tubular slider; supporting means for supporting said deflecting cone and including a plurality of tubular supporting members; and an electrical conduit provided for said switch and extending through the interior of one of said supporting members.

3. A slide valve for a container with an upright supply of a bulk material, comprising sealing means including a sealing face protected from a flow of the bulk material; means forming an inlet opening of a predetermined diameter and including an inlet tube having a portion located between said inlet opening and a plane containing said sealing face, said portion of said inlet tube forming a protection for said sealing face from the flow of the bulk material; a tubular slider movable relative to said inlet opening between an open position in which it releases an annular gap for passing the bulk material and a closed position in which it closes said annular gap; and a deflecting cone with a conical face, said deflecting cone being located under said inlet opening, having a base of a diameter exceeding the diameter of said inlet opening, and serving as a guide for said tubular slider which surrounds said deflecting cone, said tubular slider having a lower end face which is closed and an upper edge which abuts against said sealing face in said closed position and is substantially flush with said conical face of said deflecting cone in said open position, and said sealing face being located above said inlet opening.

4. A slide valve as defined in claim 3, wherein said tubular slider is pneumatically movable; and further comprising pneumatic means arranged for moving said tubular slider.

5. A slide valve as defined in claim 3, wherein said sealing face against which said upper edge of said tubular slider abuts is protected from flow of the bulk material.

6. A slide valve as defined in claim 3, wherein said tubular slider has a lower end face; and further comprising a bottom plate which closes said lower end face of said tubular slider.

7. A slide valve as defined in claim 3, where said inlet tube forms together with said tubular slide an annular space; and further comprising means for supporting said deflecting cone and located in said annular space.

8. A slide valve as defined in claim 7, wherein said supporting means includes a plurality of tubular supporting members which suspend said deflecting cone and extend in said annular space.

9. A slide valve as defined in claim 6; and further comprising pneumatic means for pneumatically moving said tubular slider and including a cylinder-and-piston unit with a piston rod connected with said bottom plate.

10. A slide valve as defined in claim 9; and further comprising means for connecting said piston rod of said cylinder-and-piston unit and including at least one threaded member.

11. A slide valve as defined in claim 10, wherein said tubular slider has a predetermined weight; and further comprising means substantially compensating the weight of said tubular slider.

12. A slide valve as defined in claim 11, wherein said compensating means includes a helical pressure spring associated with said cylinder-and-piston unit and abutting against its piston.

13. A slide valve as defined in claim 2, wherein said electrical end switch is located below said deflecting cone.

14. A slide valve as defined in claim 3, wherein said deflecting cone has a region of a maximum diameter and transits in said region into a cylindrical face forming a guiding face for said tubular slider.

* * * * *